US009095036B2

(12) United States Patent
Johnstone

(10) Patent No.: US 9,095,036 B2
(45) Date of Patent: Jul. 28, 2015

(54) METHOD AND SYSTEM FOR STABLE DYNAMICS AND CONSTANT BEAM DELIVERY FOR ACCELERATION OF CHARGED PARTICLE BEAMS IN A NON-SCALING FIXED FIELD ALTERNATING GRADIENT MAGNETIC FIELD ACCELERATOR

(75) Inventor: Carol Johnstone, Warrenville, IL (US)

(73) Assignee: PARTICLE ACCELERATOR CORPORATION, Batavia, IL (US)

( * ) Notice: Subject to any disclaimer, the term of this patent is extended or adjusted under 35 U.S.C. 154(b) by 0 days.

(21) Appl. No.: 13/594,097

(22) Filed: Aug. 24, 2012

(65) Prior Publication Data

US 2014/0055058 A1 Feb. 27, 2014

(51) Int. Cl.

| | |
|---|---|
| ***H05H 15/00*** | (2006.01) |
| ***H05H 7/06*** | (2006.01) |
| *H05H 13/08* | (2006.01) |

(52) U.S. Cl.

CPC ..... *H05H 7/06* (2013.01); *H05H 13/085* (2013.01); *H05H 13/08* (2013.01)

(58) Field of Classification Search

USPC ..... 315/500–503

See application file for complete search history.

(56) References Cited

U.S. PATENT DOCUMENTS

| | | | | |
|---|---|---|---|---|
| 7,582,886 | B2 * | 9/2009 | Trbojevic | 250/492.3 |
| 7,880,146 | B2 * | 2/2011 | Johnstone | 250/396 R |
| 7,953,205 | B2 * | 5/2011 | Balakin | 378/69 |
| 2007/0273383 | A1 * | 11/2007 | Johnstone | 324/463 |
| 2012/0013274 | A1 * | 1/2012 | Bertozzi et al. | 315/504 |

OTHER PUBLICATIONS

Johnstone, Carol, et al., "*Fixed Field Circular Accelerator Designs*", *Proceedings of the 1999 Particle Accelerator Conference (PAC) '99*, New York, pp. 3068-3070.

Jonstone, Carol, et al., "*1 GeV CW Nonscaling FFAG for ADS, and Magnet Parameters*", *Proceedings of IPAC2012*, Jul. 1, 2012, pp. 4118-4120 ISBN 978-3-95450-115-1.

Johnstone, Carol et al., "*A 1 GeV CW FFAG High Intensity Proton Driver*", *Proceedings of IPAC2012*, New Orleans, Louisiana, Jul. 1, 2012, pp. 3234-3236, ISBN 978-3-95450-115-1.

Johnstone, Carol, et. al., "*A CW FFAG for Proton Computed Tomography*", *Proceedings of IPAC2012*, New Orleans, Louisiana, Jul. 1, 2012, pp. 4094-4096, ISBN 978-3-95450-115-1.

Johnstone, C., "*Isochronous (CW) High Intensity Non-Scaling FFAG ProtonDrivers*", *Proceedings of 2011 Particle Accelerator Conference*, 27 pages.

(Continued)

*Primary Examiner* — Douglas W Owens
*Assistant Examiner* — Srinivas Sathiraju
(74) *Attorney, Agent, or Firm* — Leydig, Voit & Mayer, Ltd.

(57) ABSTRACT

An accelerator system includes a plurality of cells. Each cell includes a focus magnet and a defocus magnet each configured to create a magnetic field so as to confine and accelerate a particle beam, the focus magnet being configured to focus the particle beam in a horizontal direction and defocus the particle beam in a vertical direction, and the defocus magnet being configured to focus the particle beam in a vertical direction and defocus the particle beam in a horizontal direction. Each of the plurality of cells is configured to confine the particle beam in an isochronous orbit during acceleration. The accelerator system is a non-scaling fixed field alternating gradient particle accelerator (FFAG).

20 Claims, 4 Drawing Sheets

(56) References Cited

OTHER PUBLICATIONS

Johnstone, C., et al., "*Isochronous (CW) Non-Scaling FFAGs: Design and Simulation*", *AIP Conference Proceedings*, Jan. 1, 2010, pp. 682-687, XP055136150.

*European Search Report*dated Sep. 29, 2014 for co-pending European Patent Application No. 13 18 463, (14 pages).

Rees, G.H., "*Design of an Isochronous FFAG Ring for Muon Acceleration*", ICFA Beam Dynamics Newsletter, No. 43, Aug. 2007, pp. 74-83.

Johnstone, Carol, "*Innovations in Fixed-Field Accelerators: Design and Simulation*", *Proceedings of CYCLOTRONS 2010*, Lanzhou, China, THA1CIO03, pp. 389-394.

* cited by examiner

METHOD AND SYSTEM FOR STABLE DYNAMICS AND CONSTANT BEAM DELIVERY FOR ACCELERATION OF CHARGED PARTICLE BEAMS IN A NON-SCALING FIXED FIELD ALTERNATING GRADIENT MAGNETIC FIELD ACCELERATOR

FIELD

This application relates to continuous beam (CW) particle accelerators, and in particular to non-scaling fixed field alternating gradient (FFAG) machines in which charged particles are confined to isochronous orbits while being accelerated to a desired energy.

BACKGROUND

Accelerators are becoming increasingly important in medicine, clean energy and national security. Accelerators can be used for safer nuclear reactors, industrial irradiation, cancer therapy and cargo inspection.

A strong economic consideration is accelerator footprint; synchrotrons and linacs typically reserve much larger civil accommodations. With its compact footprint and continuous beam current, both high and low intensity, the cyclotron is the current industrial and medical standard. A new player to advanced accelerator applications is the Fixed Field Alternating Gradient Accelerator (FFAG), including a scaling FFAG version and a more recent invention, a non-scaling FFAG.

The so-called scaling FFAG (either spiral or radial-sector FFAGs) is characterized by geometrically similar orbits of increasing radius. Direct application of high-order magnetic fields and edge focusing maintains a constant tune and optical functions during the acceleration cycle and avoids low-order resonances. In general, scaling FFAG designs are not compatible with isochronous orbits and therefore not compatible with CW operation.

The non-scaling FFAG was subsequently developed (C. Johnstone, et al., "Fixed Field Circular Accelerator Designs", PAC '99, New York, P. 3068.). The non-scaling FFAG was proposed for muon acceleration and utilized simple, combined function magnets like a synchrotron. However, it did not maintain a constant tune and was not suitable for an accelerator with a modest RF system and a slower acceleration cycle.

An initial approach to tune stabilization in a linear-field non-scaling FFAG was developed (See U.S. Pat. No. 7,880,146 B2; "Tune-stabilized, non-scaling, fixed-field, alternating gradient accelerator", Johnstone, Carol J.) in which a set of seven equations relate a number of parameters specifying focus and defocus magnets together. A linear field condition was assigned in order to stabilize machine tune, but given the linear condition, compact stable orbits cannot be achieved at near relativistic and relativistic energies.

Further, U.S. Publication No. 2012/013274 describes a Non-Scaling FFAG Accelerator design, wherein the linear field condition is removed in order to realize advanced machine properties and optimal designs. The nonlinear field condition, or high-order field, allows for more constant machine tune as a function of momentum or energy and more compact machines resulting in smaller apertures. Limits were set on the extraction and injection radii for compact machines in an optimizer search for stable solutions, but this is a constraint that does not reflect fundamental dynamics unlike limits required on cell phase advance or tune. These additional conditions were imposed only to guide the optimizer search but do not comprise a solution.

With the cyclotron as the current industrial and medical standard, a competing CW FFAG could potentially have a broad impact on medical accelerators, proton drivers for neutron production, accelerator-driven nuclear reactors, accelerator transmutation of waste (ATW), and production of radiopharmaceuticals, as well as open up a range of as-yet unexplored industrial applications.

SUMMARY OF THE INVENTION

In an embodiment, the present invention provides an accelerator system including a plurality of cells. Each cell includes a focus magnet and a defocus magnet each configured to create a magnetic field so as to confine and accelerate a particle beam, the focus magnet being configured to focus the particle beam in a horizontal direction and defocus the particle beam in a vertical direction, and the defocus magnet being configured to focus the particle beam in a vertical direction and defocus the particle beam in a horizontal direction. Each of the plurality of cells is configured to confine the particle beam in an isochronous orbit during acceleration. The accelerator system is a non-scaling fixed field alternating gradient particle accelerator (FFAG).

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
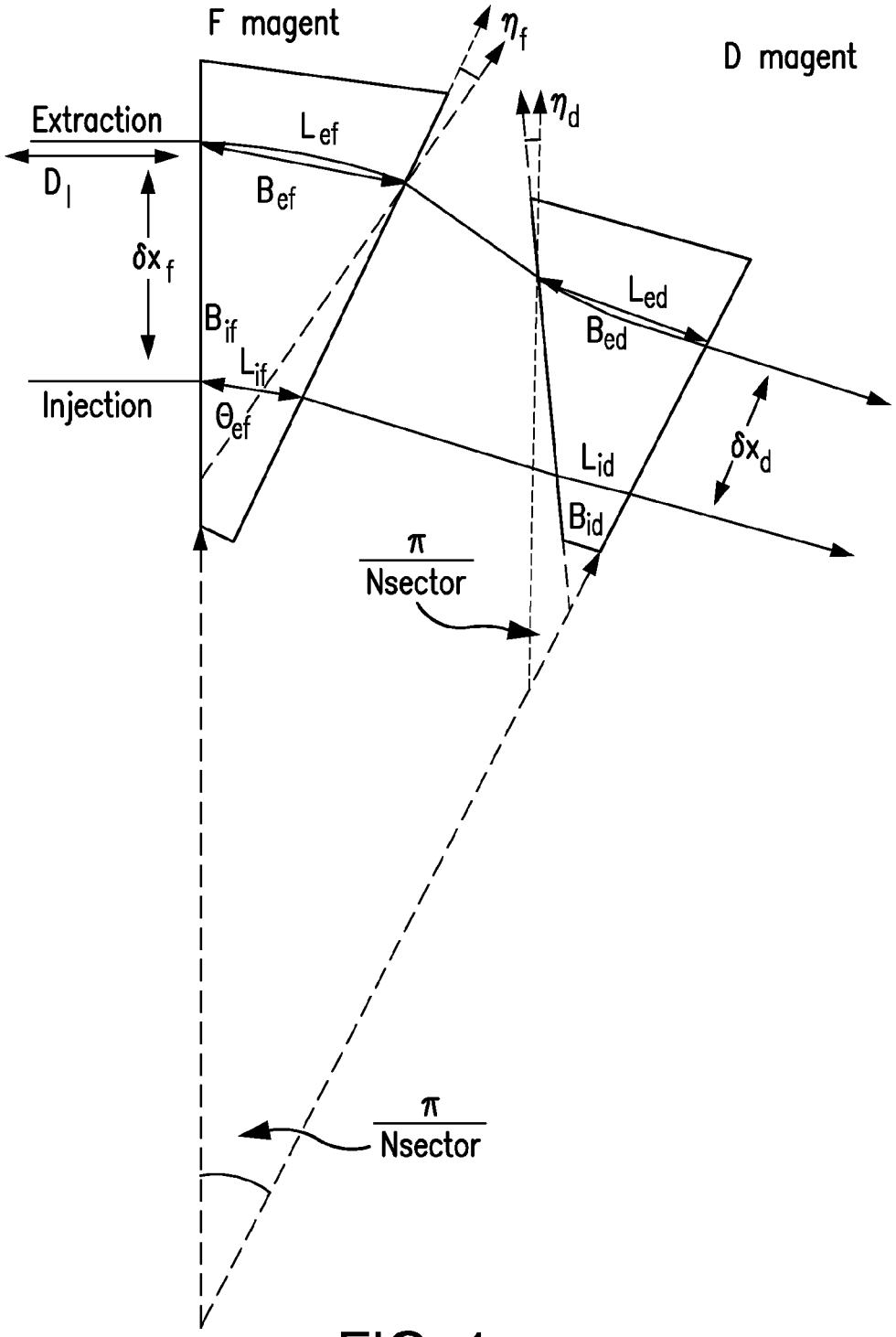
FIG. 1 shows a layout and certain parameters of half of a configuration for a standard unit cell using a pair of FFAG magnets.

In an embodiment, the present invention provides a non-scaling FFAG accelerator in which charged particles are confined to isochronous orbits while being accelerated to a desired energy. In a further embodiment, the present invention provides a method by which a CW beam can be successfully controlled and accelerated in a non-scaling FFAG. In an embodiment, the particle beam includes a proton beam.

The capability to produce a CW beam represents a significant innovation over previous accelerators and greatly extends the performance and applications of the non-scaling FFAG in direct competition with the conventional cyclotron. A CW non-scaling FFAG implies orbits in the accelerator are isochronous, wherein the revolution time of a particle beam as it accelerates is constant, and therefore a fixed-frequency (rather than a swept-frequency) Radio Frequency (RF) acceleration system can be employed. Fixed-frequency RF allows the particle beam to be continuously injected and accelerated.

As described herein, a stable CW accelerator design for a non-scaling FFAG can be achieved based on closed reference orbits (geometry), stable machine tune (focusing strength of field gradient combined with edge and centripetal focusing effects), and constraint of total path length according to an isochronous condition.

Compact high-performance devices like FFAG-type accelerators and cyclotrons often are operated in a regime where space charge effects become significant. The strong focusing attribute, particularly in a vertical of the FFAG, implies some degree of mitigation of space-charge effects and possible stable acceleration of higher currents.

In general, in a recirculating accelerator with fixed magnetic fields, stable orbits require that the integrated magnetic strength scales with the central momentum of the particle beam and that this strength accurately tracks with the desired position of the particle beam as it moves outward across a magnetic aperture during acceleration. In the case of most cyclotrons, the magnetic field is near uniform in a radial direction (azimuthally the field periodically increases and decreases; i.e. the so-called hills and valleys) and particles move outward, traversing longer and longer orbital paths through the magnetic field as the energy increases. This longer path length in magnetic fields, which is required for beam confinement, is obtained using magnets with sector or spiral-shaped pole faces. The field strength integrated over a total path length must scale in proportion to momentum as the beam accelerates.

In the case of a fixed field alternating gradient (FFAG) accelerator, the magnetic field strength at a given point in space does not vary in time, but unlike a conventional cyclotron, the FFAG generally has a stronger spatial variation with radius (a field gradient) to confine particles as they gain energy and their orbits change accordingly, thus the magnetic field frequently increases strongly as a function of radius. This strong field gradient, which is an arbitrary gradient in the case of a non-scaling FFAG, not only allows stronger but also simultaneous control over important machine parameters relative to the conventional cyclotron. Reverse gradients can also be incorporated as in a synchrotron which has the added potential of improving vertical plane optics.

Of particular importance to the isochronous invention is simultaneous control over machine tune, which is the integrated phase advance of a beam particle in one turn around the accelerator in combination with the beam particle's integrated path length over this turn. Both the cell phase advance and the corresponding machine tune in a storage or accelerator ring are critical to confine beam and impose stable dynamics. For isochronous acceleration, where the revolution time is independent of energy, the path length must also be controlled as a function of energy.

In an embodiment, a unique approach has been developed to control cell phase advance, and therefore machine tune, to promote stable beam optics along with path length, which is the basis for the isochronous invention described herein. In the examples that follow, an average radius is computed over a half or full cell so that the integrated path length is given by $2\pi \times R_{avg}$. Each cell contains a focus magnet (F magnet) and a defocus magnet (D magnet), each configured to create a magnetic field so as to confine and accelerate the particle beam. The F magnet is configured to focus the particle beam in a horizontal direction and defocus the particle beam in a vertical direction, and the D magnet is configured to focus the particle beam in a vertical direction and defocus the particle beam in a horizontal direction. Thus, the isochronous condition can be imposed by making the average radius scale with the relativistic velocity. Another implementation requires only an F magnet with edge focusing applied for vertical confinement.

Further, the isochronous non-scaling FFAG designs presented herein are completely periodic and constructed entirely from a sequence of identical unit cells. The periodic cell structure exhibits reflective symmetry, and therefore the optics can be completely described by half of one of these cells.

Examples of accelerators designed by the methods according to the isochronous condition disclosed herein are presented in three separate energy regimes:

a) Nonrelativistic 50 keV-8 MeV low-energy proton accelerator with a preliminary isochronous performance at a level of +/−1%;
b) Relativistic 30-330 MeV proton accelerators representing a momentum gain of 357%, with a preliminary isochronous performance at a level of ≤1.5%; and
c) Ultra-relativistic 0.25 and 0.33-1 GeV (kinetic energy) proton accelerators, representing a momentum gain of 233% and isochronous at a level of ≤3% in a revolution period.

These designs demonstrate the nature of a field behavior required to construct an isochronous non-scaling FFAG in the three separate energy regimes. These three energy regimes require different field patterns and radial field profiles: a predominately linear-gradient radial field at low energy to a high-order nonlinear gradient field at GeV energies. All designs can be physically realized with a good magnet design.

The isochronous condition in all machines restricts the extraction/injection radii to specific ratios depending on the relativistic velocity. As the energy becomes relativistic and the change in velocity as a function of energy and momentum decreases, the orbits become closer together with a corresponding decrease in machine aperture. Eventually the technical design becomes impractical with the required nonlinear field rise as machine radius becomes technically unachievable in the GeV range (~2 GeV at extraction).

According to the new methodology described herein, magnetic fields can be produced that are dominated by linear field gradients at low, nonrelativistic energies with field expansion becoming increasingly nonlinear as the energy transitions to a relativistic regime. The guide field magnets in these new designs retain simple wedge shapes, but field components, both linear and nonlinear, are systematically introduced to achieve the more advanced machine dynamics and operation required. The type and magnitude of the field content remain dependent on machine geometry, energy reach and application.

The innovation developed involves the addition of an eighth, isochronous condition to seven fundamental dynamics and geometric equations for stable tune and acceleration, as presented in U.S. Pat. No. 7,880,146 ("the '146 patent"), the entire disclosure of which is incorporated by reference herein. According to this new isochronous condition, a solution for the seven fundamental equations exists that also makes the revolution time constant. The radial magnetic field, or B field, can be solved as a function of radius and magnet parameters that preserves not only the required geometry and stable tune conditions, but also the revolution time, i.e. integrated path length scaled with velocity.

In an embodiment of the invention, the isochronous condition and the seven fundamental equations are added to an optimizer, or solver, which attempts to find solutions preserving all input accelerator dynamical conditions simultaneously. A strongly nonlinear field profile is particularly important for achieving isochronous orbits (CW operation) at high, relativistic energies (~GeV) where cyclotrons break down and synchro-cyclotrons (swept-frequency, not CW) must be used. This invention is therefore particularly important for high-power, high energy applications such as Accelerator Driven Systems (ADS), ATW, as well as low-power, high-energy applications such as carbon cancer radiotherapy. These applications require energies in an energy regime where cyclotrons can become unfeasibly large or non-isochronous, or can encounter stability issues.

In the linear gradient case described in the '146 patent, 7 equations and 12 variable parameters were provided, and therefore 5 of the parameters were specified to solve the set of equations. For the '146 patent, the horizontal cell tune at extraction that is specified in equation 2a (set forth below) was set equal to the injection horizontal cell tune and propagated to the other dimensions in 1a, 3a, and 4a (set forth below) along with specification of an extraction drift and periodicity. For higher orders of fields more constraints are needed.

Figure 2:
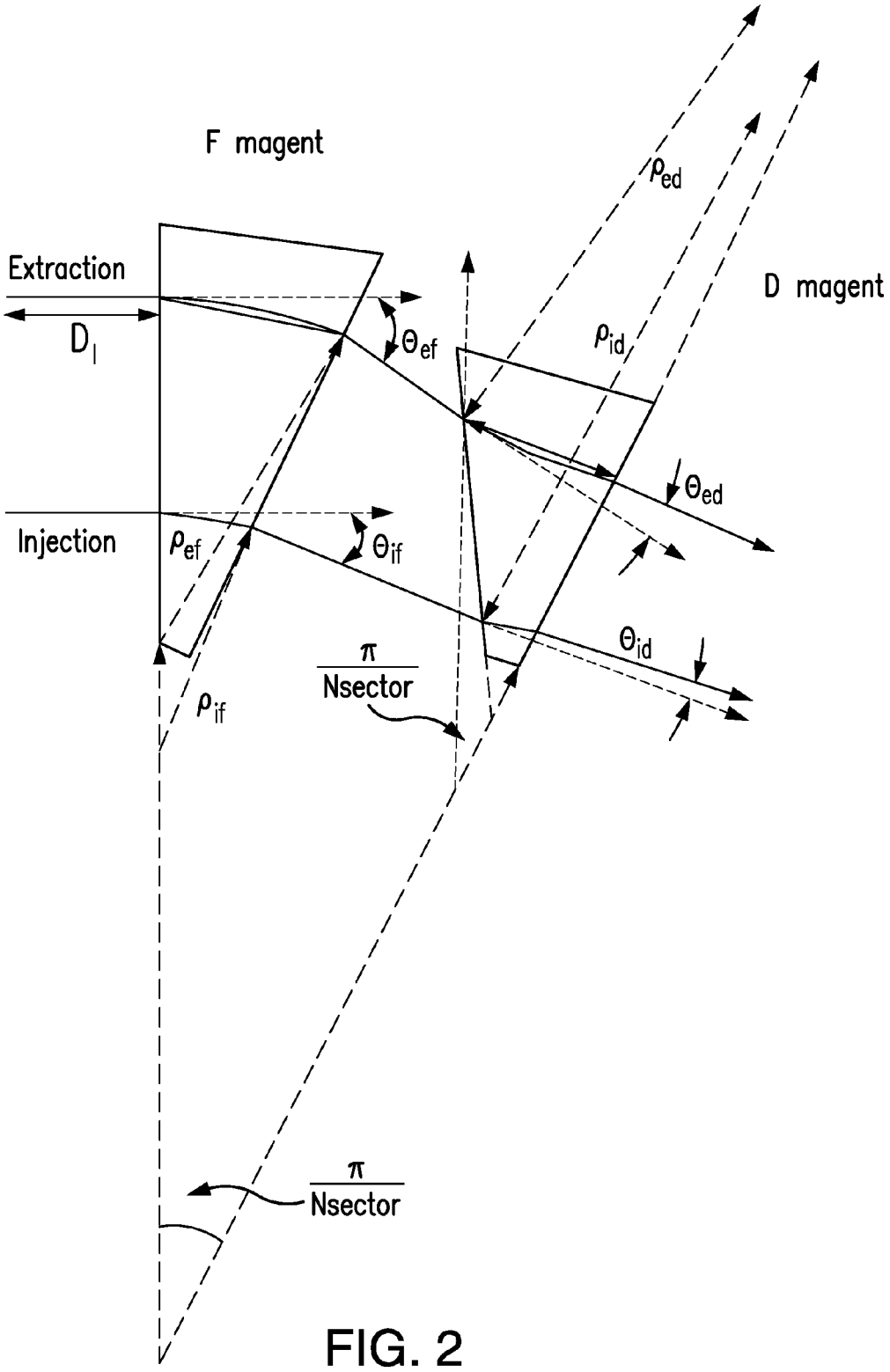
FIG. 2 shows a layout and certain parameters of a half of a configuration for a standard unit cell of FFAG magnets.

The eight equations, including the seven fundamental equations and the new eighth equation are described in this section. FIGS. 1 and 2 show the relation of the parameters in the eight equations to the focus (F) and defocus (D) physical magnet design.

The eight equations include thirteen variables listed below which describe the physical attributes of the individual magnets. Regarding the nomenclature of the variables, "e" and "i" denote extraction and injection, subscripts "f" and "d", horizontally focusing and defocusing magnets, and 'f', the thin lens focal length. The thirteen variables include:

$D_e$ Drift distance between F and D magnets at extraction $L_{if}$, $L_{ef}$, $L_{id}$, $L_{ed}$ F and D Magnet half-lengths at injection and extraction $B_{if}$, $B_{ef}$, $B_{id}$, $B_{ed}$ F and D Magnet fields at injection and extraction $\delta x_{if}$ Distance from the injection orbit to the extraction orbit in the F magnet $\eta_f$; $\eta_d$ Linear edge angles for the F and D magnets Nsectors Number of cells in the ring In order to determine the magnetic fields of the F and D magnets at injection and extraction ($B_{if}$, $B_{ef}$, $B_{id}$, $B_{ed}$), the extraction field is related to the injection field according to an arbitrary conventional Taylor expansion of multipoles as shown below. Therefore, the number of actual free parameters depends on the order of the expansion. For example, to obtain a linear gradient the number of free variables remains at four ($B_{of}$; $a_f$; $B_{od}$, $a_d$), yielding a total of thirteen free parameters. Each consecutive field order adds two additional free parameters. Although other expansions have been used (Legendre, for example), a Taylor expansion is used here because it represents the conventional description of multipole content in a magnetic field. The order of the field varies depending on the optimal solution and desired criteria and is therefore selected by the optimizer. Not all of the field expansion coefficients set forth below are required in all of the machine designs, rather, the field expansions shown serve to indicate the highest order used in the current machine designs.

Magnetic field expansion at extraction in F magnet:

$$B_{ef}=B_{0f}+a_f\delta x_{ef}+b_f\delta x^2_{ef}+c_f\delta x^3_{ef}+d_f\delta x_{ef}^4+e_f\delta x_{ef}^5+f_f\delta x_{ef}^6$$

Magnetic field expansion at extraction in D magnet:

$$B_{ed}=B_{0d}+a_d\delta_{ed}+b_d\delta x_{ed}^2+c_d\delta x^3_{ed}+d_d\delta x_{ed}^4+e_d\delta x^5_{ed}+f_d\delta x_{ed}^6$$

Magnetic field expansion at injection in F magnet:

$$B_{if}=B_{0f}+a_f(\delta x_{ef}-\delta x_{if})+b_f(\delta x_{ef}-\delta x_{if})^2+c_f(\delta x_{ef}-\delta x_{if})^3++d_f(\delta x_{ef}-\delta x_{if})^4+e_f(\delta x_{ef}-\delta x_{if})^5+f_f(\delta x_{ef}-\delta x_{if})^6$$

Magnetic field expansion at injection in D magnet:

$$B_{id}=B_{0d}+a_d(\delta x_{ed}-\delta x_{id})+b_d(\delta x_{ed}-\delta x_{id})^2+c_d(\delta x_{ed}-\delta x_{id})^3++d_d(\delta x_{ed}-\delta x_{id})^4+e_d(\delta x_{ed}-\delta x_{id})^5+f_d(\delta x_{ed}-\delta x_{id})^6$$

The field expansion is expressed in terms of variables relative to the extraction orbit; for example, $\delta x_{if}$ is the distance from injection to extraction in the F magnet such that the increasing values for the field correspond to increasing values of radius. The value $\delta x_{ef}$ is the distance from the point about which the magnetic (B) field is radially expanded to the position of the extraction orbit. At that expansion point, the field has the value $B_{0f}$. The value for this position variable, $\delta x_{ef}$, along with the variable $B_{0f}$; is selected by the optimizer. The general radial parameter, $\delta x$, which characterizes the field profile, is a coordinate relative to the extraction orbit and is not the same as the average physical radius, $R_e$, of the extraction orbit used to compute the integrated path length of the beam at extraction.

The extraction orbit often proves to be the most critical for most designs because it generally requires the highest field values and is used as the starting point in these machine designs. It is possible to expand from the injection orbit, but critical computational accuracy is lost in solving for a solution starting with small values and integrating to large ones, thus compromising the optimizer when solving for the best solution.

Once the magnetic fields of the F and the D magnets are determined, in order to model magnetic focusing and deflection of the particle beam in the magnetic cell, the magnetic field is treated as a thick lens. In the actual design, thick-lens formulae are used to calculate and constrain the tune which is given by the traces of the thick-lens linear matrices. The following equations generate the half-cell tune or phase advance in the horizontal and vertical for a FDF magnet configuration as calculated from the half-cell thick lens matrices, wherein a full cell is constructed from a half cell using reflective symmetry.

$$2\cos\varphi_H = Tr\begin{bmatrix}\cosh\sqrt{k_d}\,l_d & \sinh\sqrt{k_d}\,l_d/\sqrt{k_d}\\ -\sqrt{k_d}\sinh\sqrt{k_d}\,l_d & \cosh\sqrt{k_d}\,l_d\end{bmatrix}\begin{bmatrix}1 & 0\\ \tan\eta_d/\rho_d & 1\end{bmatrix}\begin{bmatrix}1 & D\\ 0 & 1\end{bmatrix}\times\begin{bmatrix}1 & 0\\ -\tan\eta_f/\rho_f & 1\end{bmatrix}\begin{bmatrix}\cos\sqrt{k_f}\,l_f & \sin\sqrt{k_f}\,l_f/\sqrt{k_f}\\ -\sqrt{k_f}\sin\sqrt{k_f}\,l_f & \cos\sqrt{k_f}\,l_f\end{bmatrix}\begin{bmatrix}1 & D_l\\ 0 & 1\end{bmatrix}$$

$$2\cos\varphi_V = Tr\begin{bmatrix}\cos\sqrt{k_d}\,l_d & \sin\sqrt{k_d}\,l_d/\sqrt{k_d}\\ -\sqrt{k_d}\sin\sqrt{k_d}\,l_d & \cos\sqrt{k_d}\,l_d\end{bmatrix}\begin{bmatrix}1 & 0\\ -\tan\eta_d/\rho_d & 1\end{bmatrix}\begin{bmatrix}1 & D\\ 0 & 1\end{bmatrix}\times\begin{bmatrix}1 & 0\\ \tan\eta_f/\rho_f & 1\end{bmatrix}\begin{bmatrix}\cosh\sqrt{k_f}\,l_f & \sin\sqrt{k_f}\,l_f/\sqrt{k_f}\\ -\sqrt{k_f}\sinh\sqrt{k_f}\,l_f & \cos\sqrt{k_f}\,l_f\end{bmatrix}\begin{bmatrix}1 & D_l\\ 0 & 1\end{bmatrix}$$

The matrices start at the midpoint of a long straight, which is inserted between the two F magnets center, and end at the center of the D magnet for an FDF magnet configuration, or similarly, a long straight may be inserted between two D magnets for a DFD magnet configuration. In these cases, the thick-lens tune equations are not impacted, and only an additional parameter, a length of the long straight, is required. The value of the long straight length is not free, but is fixed by the designer.

Where one substitutes the magnet lengths at a specific energy point (such as extraction), the drift is the distance between the F and D magnets and the gradient, k=B' is the derivative of the B field at the chosen energy point. $D_1$ is the half length of a drift inserted between the F magnets as in FIG. 3 (this drift can also be inserted between the two D magnets in a DFD configuration). The symbol ϕ is the phase advance or tune across the half cell.

This phase advance or cell-tune tune relationship will be used below to demonstrate different expressions for the same constraint equations and to relate physical properties of the magnet layout with the cell phase advance. It should also be noted that a negative ρ reverses the sign of the edge crossing term in the vertical equation. The edge-angle convention here is opposite many conventional usages such that a positive value of η corresponds to an outward bend wherein path length increases from injection to extraction.

For a completely periodic magnetic field solution, or lattice, as is the case in the designs here, the first four equations serve to specify the machine tune at injection and extraction (when multiplied by twice the number of half cells). In these equations, f represents a thin-lens focal length of the half cell, which is related to the tune or phase advance of the half cell by $$\sin\frac{\varphi}{2} = L_{half} / f$$

where $L_{half}$ is the half-cell length and ϕ is the full cell phase advance. For example, for ϕ=90°, f=1.4 $L_{half}$ where $L_{half}$ is the sum of the two magnet half-lengths plus the intervening drift.

In the equations presented herein, the thin lens approximation is used in order to obtain a general equation form, followed by an equation form representing the optimal linear-gradient solution. The general equations reduce to a simpler form when the field expansion is truncated after the first coefficient and after the optimal solution is introduced.

$$k_{if} l_{if} + \frac{\theta_{if}}{\rho_{if}} + \frac{((\theta_{ef} - \theta_{if}) + \eta_{if})}{\rho_{if}} = 1 / f_{if}; \quad 1)$$

$B_{if}$=0 is the optimized linear-gradient solution ⇒ $\theta_{if}$=0 and $\rho_{if} \to \infty$; or $k_{if} l_{if} = 1/f_{if}$; for a linear gradient (coefficients≥b=0)

$$k_{id} L_{id} + \frac{\theta_{if} + \eta_{id}}{\rho_{id}} = 1 / f_{id} \quad 2)$$

reduces to $$k_{id} L_{id} + \frac{\eta_{id}}{\rho_{id}} = 1 / f_{id} \text{ for } B_{if} = 0 \text{ and } \theta_{if} = 0 \quad 3)$$

$$k_{ef} L_{ef} + \frac{\theta_{ef}}{\rho_{ef}} + \frac{\eta_{ef}}{\rho_{ef}} = 1 / f_{ef}$$

using $$\sin\left(\frac{\varphi}{2}\right) = \frac{L_{1/2}}{f_{ef}}$$

where $L_{1/2}$ is the length of the half cell and ϕ is the phase advance across a half cell, the focal length can also be expressed as $$\frac{\sin\left(\frac{\varphi}{2}\right)}{(L_{ef} + L_{ed} + D_e)} = 1 / f_{ef} \quad 4)$$

$$k_{ed} L_{ed} + \frac{\theta_{ef} + \eta_{ed}}{\rho_{ed}} = 1 / f_{ed}$$

In the general equations the phase advance or cell tune, 1/f, is expressed independently for injection and extraction in the vertical and the horizontal. For the case of a linear gradient, the optimized and most stable solution required the magnetic field at injection in the F magnet to be equal to 0. When this null field is incorporated, the form of the equations reduces to the equations presented in the '146 patent, which equations may be solved analytically. These equations are:

1a) $1/f_{if} = 1/f_{id}$; (horizontal injection half cell tune=vertical injection half cell tune)
for $B_{if}$=0

$$k_{if} L_{if} = k_{id} L_{id} + \frac{\eta_{id}}{\rho_{id}} = 1 / f_{id};$$

2a) $1/f_{if} = 1/f_{ef}$; (horizontal injection half cell tune=horizontal extraction half cell tune)=

$$k_{if} L_{if} = \frac{\sin\left(\frac{\varphi}{2}\right)}{(L_{ef} + L_{ed} + D_e)}$$

3a) $1/f_{if} = 1/f_{ef}$; relating the standard thin-lens expansions to field/bend angles and edge angle $$k_{if} L_{if} = k_{ef} L_{ef} + \frac{\theta_{ef}}{\rho_{ef}} + \frac{\eta_{ef}}{\rho_{ef}}$$

4a) $1/f_{id} = 1/f_{ed}$; set vertical injection half cell tune=vertical extraction half cell tune $$k_{id} L_{id} + \frac{\eta_{id}}{\rho_{id}} = k_{ed} L_{ed} + \frac{\theta_{ef} + \eta_{ed}}{\rho_{ed}}$$

Geometric closure of reference orbits is imposed in the fifth equation (set forth below), in which the net bend per cell is set equal at injection and extraction. For a beam to circulate, the net cell bend must be the appropriate fraction of 2π per number of cells comprising a full ring:

$$\theta_{if} + \theta_{id} = \theta_{ef} + \theta_{ed} = \theta_{halfcell}; \quad 5)$$

$$= \theta_{id} \text{ for } \theta_{if} = 0 \text{ (linear gradient optimal solution) with}$$

$$\theta_{halfcell} = \pi / Nsectors \text{ (ring geometric closure condition)}$$

The last two equations (set forth below) are geometric in nature and describe the particle trajectory through a half cell using the fact that magnetic lengths and drifts at injection can be tied to extraction through a sector angle, edge angle and alignment of magnetic components, defining the physical linear edge, extent of the magnet and orientation. The magnetic lengths at extraction and injection are connected via a linear edge contour. For a constant edge angle, the length of the magnet at extraction is equal to the length at injection plus an additional contribution due to the angle cut of the magnet edge and the distance between the two orbits, $\delta x_{if}$ and $\delta x_{id}$. The derivations of the path length must also include the angle of the trajectories through the F and D magnets at injection and extraction, $\theta_{if}$, $\theta_{id}$, $\theta_{ef}$, and $\theta_{ed}$. The derivation assumes a starting point at the center of the F magnet which is a symmetry point so all orbits are parallel which is propagated across the drift, $D_e$ or $D_i$, and then through the D magnet with a varying crossing angle. The crossing angle which varies with energy complicates the derivation through the D magnet. Non-parallel orbits are one characteristic of a non-scaling FFAG. The D magnet edge without the edge angle is aligned parallel to the central axis of the F magnet, and the D edge angle then rotates this edge away from this initial alignment to a final alignment relative to the F magnet central axis. Further, for these last two equations, which are determined by the geometry of the reference trajectory through the half cell, particle dynamics are approximated by impulses delivered at the center of the magnets. The reduction of the trigonometric functions and setting the magnetic field at injection in the F magnet to be equal to 0, or Bif=0, leads to the 2nd representation in equations 6 and 7.

$$L_{if}[\cos(\theta_{if})+\sin(\theta_{if})\tan(\theta_{ef}+\eta_{ef})]=L_{ef}\cos(\theta_{ef})-[\delta x_{if}-L_{ef}\sin(\theta_{ef})]\tan(\theta_{ef}+\eta_{ef}) \quad 6)$$

reduces to $$l_{ef}=l_{if}+\delta x_{if}(\theta_{ef}+\eta_f) \text{ for } \theta_{if}=0$$

$$L_{ed}\cos(\theta_{ef})=L_{id}\cos(\theta_{if})+\delta x_{id}\sin(\theta_{id}+\theta_{if})+[\delta x_{if}+(L_{if}+D_i)\sin(\theta_{if})-(L_{ef}+D_e)\sin(\theta_{ef})]\tan(\eta_{ed}) \quad 7)$$

reduces to $$l_{ed}=l_{id}+\delta x_{id}(\theta_{id}+\eta_d) \text{ for } \theta_{if}=0 \text{ and } \eta_{ed}<<1$$

Isochronous Constraint Equation

An additional dynamical constraint equation is required to make the orbits isochronous at injection and extraction. Keeping the revolution time constant requires that the total path length at extraction must scale relative to the path length at injection by the ratio of the extraction velocity to the injection velocity. The following equations are implemented with the original seven constraint equations to impose an isochronous dynamical condition on the solution(s):

$$R_e(avg)=\frac{\beta_e}{\beta_i}R_i(avg); \quad 8)$$

where β is the relativistic velocity wherein the average extraction radius and injection radius are given by the following equations in terms of the magnet parameters and layout:

$$R_i(avg)=\frac{2L_i(halfcell)}{2\pi}=\frac{Nsector(L_{if}+L_{id}+D_i+D_l)}{\pi} \quad 9)$$

$$R_e(avg)=\frac{2L_e(halfcell)}{2\pi}=\frac{Nsector(L_{ef}+L_{ed}+D_e+D_l)}{\pi} \quad 10)$$

Subordinate Equations

The subordinate equations shown below describe $D_i$ and $\delta x_{id}$ in terms of the independent variables given above and represent the injection drift and orbit excursion in the D quadrupole between injection and extraction, respectively.

$$D_i[\cos(\theta_{if})-\sin(\theta_{if})\tan(\eta_{ed})]=(L_{ef}+D_e)\cos(\theta_{ef})-L_{if}\cos(\theta_{if})+[\delta x_{if}+L_{if}\sin(\theta_{if})-(L_{ef}+D_e)\sin(\theta_{ef})]\tan(\eta_{ed}) \quad 11)$$

$$\delta x_{id}\cos(\theta_{id}+\theta_{if})=\delta x_{if}+L_{ihalf}\sin(\theta_{if})-L_{ehalf}\sin(\theta_{ef}) \quad 12)$$

These subordinate equations are important in that they describe critical technical parameters: the drift between the F and D at injection, $D_i$ (which cannot be allowed to be too small) and the aperture in the D magnet, $\delta x_{id}$.

Intermediate Energies

Equations at intermediate energies can be utilized primarily at higher field orders to keep the tune from oscillating outside of stable regions between injection and extraction. This is a known property of nonlinear expansions, specifically field expansions, and not unique to this accelerator design methodology. Nonlinear field magnetic systems are commonplace in standard accelerator design. Synchrotrons, for example, utilize sextupole and octupole corrector fields in specific "families" to control tune as a function of energy or offset from the reference orbit.

Although not required, intermediate energies facilitate the optimizer search by limiting the solution set. This practice is applied for isochronous performance by constraining the path length between injection and extraction, especially at relativistic energies where the velocity is a strongly nonlinear equation of momentum and therefore integrated B field. The intermediate equations shown below are identical to those describing injection and extraction as described above, where n is simply a sequence number to identify the intermediate point.

$$k_{nf}L_{nf}+\frac{\theta_{nf}}{\rho_{nf}}+\frac{((\theta_{ef}-\theta_{nf})+\eta_{if})}{\rho_{nf}}=1/f_{nf}; \quad 13)$$

$$k_{nd}L_{nd}+\frac{\theta_{nf}+\eta_{nd}}{\rho_{nd}}=1/f_{nd}; \quad 14)$$

$$\theta_{halfcell}=\theta_{if}+\theta_{id}=\theta_{nf}+\theta_{nd} \quad 15)$$

$$L_{nf}[\cos(\theta_{nf})+\sin(\theta_{nf})\tan(\theta_{ef}+\eta_{ef})]=L_{ef}\cos(\theta_{ef})-[\delta x_{nf}-L_{ef}\sin(\theta_{ef})]\tan(\theta_{ef}+\eta_{ef}); \quad 16)$$

$$L_{ed}\cos(\theta_{ef})=L_{nd}\cos(\theta_{nf})+\delta x_{nd}\sin(\theta_{nd}+\theta_{nf})+[\delta x_{nf}+(L_{nf}+D_n)\sin(\theta_{nif})-(L_{ef}+D_e)\sin(\theta_{ef})]\tan(\eta_{ed}) \quad 17)$$

Applying the Isochronous Condition as presented above $$R_n(avg)=\frac{\beta_n}{\beta_i}R_i(avg); \quad 18)$$

where β is the relativistic velocity wherein $R_n$(avg) is defined by:

$$R_n(avg)=\frac{2L_n(halfcell)}{2\pi}=\frac{Nsector(L_{nf}+L_{nd}+D_n+D_l)}{\pi} \quad 19)$$

With the corresponding subordinate equations:

$$D_n[\cos(\theta_{nf})-\sin(\theta_{nf})\tan(\eta_{ed})]=(L_{ef}+D_e)\cos(\theta_{ef})-L_{nf}\cos(\theta_{nf})+[\delta x_{nf}+L_{nf}\sin(\theta_{nf})-(L_{ef}+D_e)\sin(\theta_{ef})]\tan(\eta_{ed}) \quad 20)$$

$$\delta x_{nd}\cos(\theta_{nd}+\theta_{nf})=\delta x_{nf}+L_{nhalf}\sin(\theta_{nf})-L_{ehalf}\sin(\theta_{ef}) \quad 21)$$

In an alternative embodiment, each cell includes a wedge-shaped focus magnet with no defocus magnet, the F magnet being configured to create a magnetic field so as to confine and accelerate the particle beam and configured to focus the particle beam in both a horizontal direction and in a vertical direction. The focus magnet parameters are related by the following equations, which include thin-lens approximations. In order to obtain vertical focusing and vertical beam stability, $\eta_f<0$.

$$k_{if} l_{if} + \frac{\theta_{if}}{\rho_{if}} + \frac{((\theta_{ef} - \theta_{if}) + \eta_{if})}{\rho_{if}} = 1/f_{if}$$

$$-\frac{\eta_{if}}{\rho_{if}} = 1/f_{id}$$

$$k_{ef} L_{ef} + \frac{\theta_{ef}}{\rho_{ef}} + \frac{\eta_{ef}}{\rho_{ef}} = 1/f_{ef}$$

$$-\frac{\eta_{ef}}{\rho_{ef}} = 1/f_{ed}$$

$$\theta_{if} = \theta_{ef} = \theta_{halfcell}$$

$$L_{if}[\cos(\theta_{if}) + \sin(\theta_{if})\tan(\theta_{ef} + \eta_{ef})] = L_{ef}\cos(\theta_{ef}) - [\delta x_{if} - L_{ef}\sin(\theta_{ef})]\tan(\theta_{ef} + \eta_{ef})$$

$$D_i[\cos(\theta_{if}) - \sin(\theta_{if})\tan(\theta_{ef} + \eta_{ef})] = (L_{ef} + D_e)\cos(\theta_{ef}) - L_{if}\cos(\theta_{if}) + [\delta x_{if} + L_{if}\sin(\theta_{if}) - (L_{ef} + D_e)\sin(\theta_{ef})]\tan(\theta_{ef} + \eta_{ef})$$

$$R_e(avg) = \frac{\beta_e}{\beta_i} R_i(avg)$$

$$R_i(avg) = \frac{2L_i(halfcell)}{2\pi} = \frac{Nsector(L_{if} + D_i + D_l)}{\pi}$$

$$R_e(avg) = \frac{2L_e(halfcell)}{2\pi} = \frac{Nsector(L_{ef} + D_e + D_l)}{\pi}.$$

EXAMPLES

As examples of accelerators designed by the methods disclosed herein, we present the following designs in three energy regimes:

a) Nonrelativistic 50 keV-6-8 MeV low-energy proton accelerator with preliminary isochronous performance at the level of +/−1%, which design applications include radioisotopes and neutron production;

b) Relativistic 30-330 MeV proton accelerators representing a momentum gain of 357%, with preliminary isochronous performance at the level of ≤1.5%, which design applications include hadron therapy, computed proton tomography, a booster for carbon therapy and ADS; and c) Ultra-relativistic 0.25 and 0.33-1 GeV (kinetic energy) proton accelerators, representing a momentum gain of 233% and isochronous at the level of ≤3% in the revolution period, which design applications include ADS and carbon hadron therapy.

As described above, the optimizer is used to find solutions to the set of fundamental equations given the imposed isochronous condition so as to solve magnetic component designs. Acceptable ranges, however, can be imposed on almost any of the parameters to achieve a stable dynamical solution within given technical constraints. Technically infeasible designs, for example, can be eliminated by setting limits to exclude nonphysical magnet lengths and unachievable field strengths. Other parameters, such as the magnet spacing, were also chosen based upon technical considerations. By setting limits on the extraction and injection radii, the footprint and aperture of the machine can be controlled, often a critical design consideration.

The standard linear matrices that describe linear optics with conventional magnet designs also neglect the angle term in the Hamiltonian and extent of the fringe fields. Final confirmation of the magnetic field solutions, the lattice, is performed by tracking the beam in an advanced accelerator code. If the design is not stable, further design iterations using the optimizer may take place until a satisfactory design is reached.

For the isochronous machine designs presented herein, the field profile was determined based on the energy regime, with the reference radii scaling with velocity. In the nonrelativistic regime, the field gradient is at most linear. As the momentum deviates from direct proportionality to velocity at near relativistic proton energies (~100 MeV), nonlinear terms become increasingly important. At the ultra-relativistic proton energies (several hundred MeV), the magnetic field rises strongly with radius and a highly nonlinear field content is required.

In the description that follows, elements or features that are the same or similar as corresponding elements and features already described are denoted by the same reference numerals in the several views of the drawings and in the description for simplicity. In the drawings, FIG. 1 includes a layout of half of a configuration for a standard unit cell which utilizes a pair of FFAG magnets. FIG. 1 consists of half of a horizontally focusing (F) magnet on the left and half of a horizontally defocusing (D) magnet on the right. Because the figure displays half of each magnet, it is reflected at either end to produce the full-cell unit. FIG. 1 includes the following parameters:

$L_{ef}$ Trajectory length in half of the F magnet at extraction [m];
$L_{if}$ Trajectory length in half of the F magnet at injection [m];
$L_{ed}$ Trajectory length in half of the D magnet at extraction [m];
$L_{id}$ Trajectory length in half of the D magnet at injection [m];
$\delta x_{if}$ Distance from injection orbit to extraction orbit, center of F magnet [m];
$\delta x_{id}$ Distance from injection orbit to extraction orbit, center of D magnet [m];
$D_l$ Length of half the long straight section [m];
$\theta_{ef}$ Angle of trajectory in half F magnet at extraction [rad];
$\theta_{ed}$ Angle of trajectory in half D magnet at extraction [rad];
$\theta_{if}$ Angle of trajectory in half F magnet at injection [rad];
$\theta_{id}$ Angle of trajectory in half D magnet at injection [rad];
$\eta_{if}$ Edge angle of F magnet at injection [rad];
$\eta_{ef}$ Edge angle of F magnet at extraction [rad];
$\eta_{id}$ Edge angle of D magnet at injection [rad]; and
$\eta_{ed}$ Edge angle of D magnet at extraction [rad].

As currently modeled, $\eta_{ef}=\eta_{if}=\eta_f$, the edge angle relative to the sector angle at extraction as shown in FIG. 1. Also $\eta_{ed}=\eta_{id}=\eta_d$ which is the angle shown in FIG. 1.

FIG. 2 includes a layout of half of a configuration for a standard unit cell which utilizes a pair of FFAG magnets and includes the following additional parameters where B is expressed in Tesla:

$\rho_{ef}$ Radius of trajectory in F magnet at extraction [m];
$\rho_{ed}$ Radius of trajectory in D magnet at extraction [m];
$\rho_{if}$ Radius of trajectory in F magnet at injection [m];
$\rho_{id}$ Radius of trajectory in D magnet at injection [m];
$\rho_{ef}=P_{extract}/0.3B_{ef}$
$\rho_{ed}=P_{extract}/0.3B_{ed}$
$\rho_{if}=P_{extract}/0.3B_{if}$
$\rho_{ed}=P_{extract}/0.3B_{ed}$ In another embodiment, a straight, magnet-free section can be inserted immediately before the half F magnet (effectively at its centerline) and/or after the half D magnet (also at its centerline). Insertion of a straight section for injection, extraction or acceleration purposes at points of reflective symmetry minimizes the impact on the stable optics but allows a powerful long section for acceleration, diagnostics, injection and extraction purposes.

Figure 3:
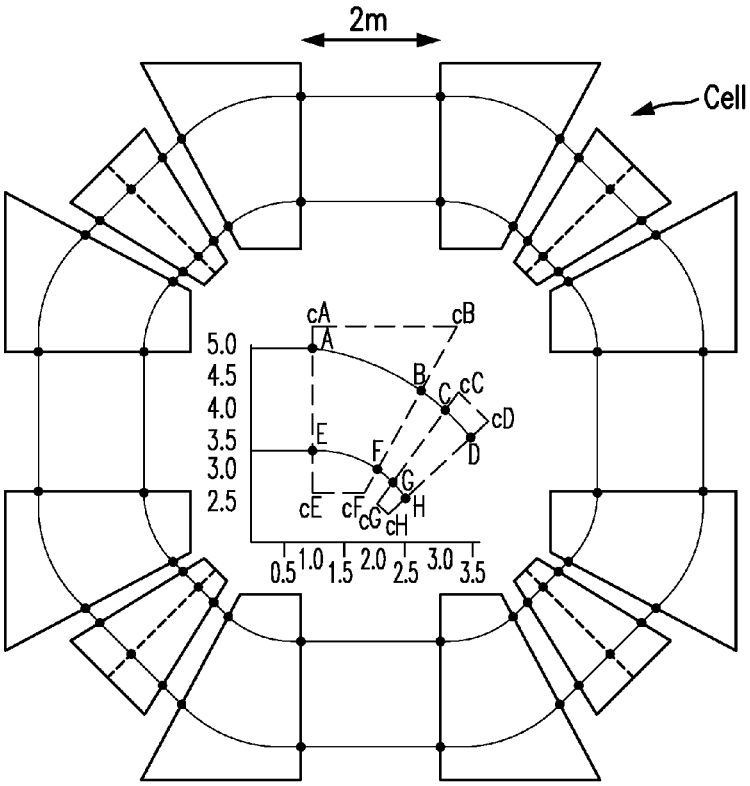
FIG. 3 shows an entire FFAG magnet system as constructed from four identical unit cells to form a recirculating ring layout for a 0.25-1 GeV machine.

FIG. 3 shows an entire FFAG magnet system as constructed from four identical unit cells as shown in FIGS. 1 and 2 to form a recirculating ring layout for a 0.25-1 GeV machine. The number of cells can vary depending on energy, ring size, and magnet aperture.

Figure 4:
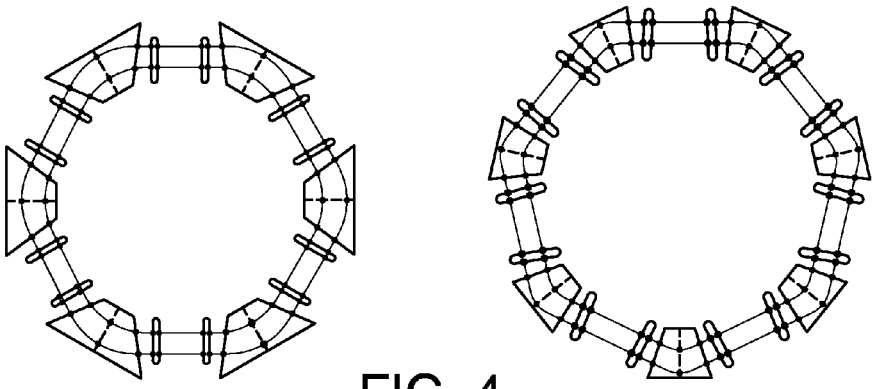
FIG. 4 shows a 6- and a 7-cell version of a 0.33 to 1 GeV isochronous FFAG magnet system.

FIG. 4 shows a 6- and a 7-cell configuration of a 0.33 to 1 GeV isochronous FFAG magnet system constructed from the unit cell shown in FIGS. 1 and 2.

Figure 5:
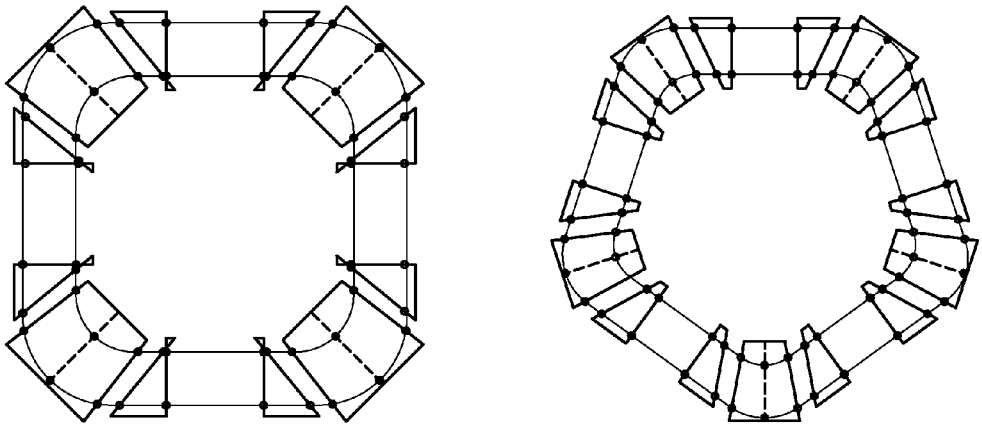
FIG. 5 shows a full ring layout for a 4- and a 5-cell version of a 30-330 MeV isochronous FFAG accelerator.

FIG. 5 shows the full ring layouts for 4- and 5-cell versions of a 30-330 MeV isochronous FFAG accelerators constructed from the unit cell shown in FIGS. 1 and 2.

Figure 6:
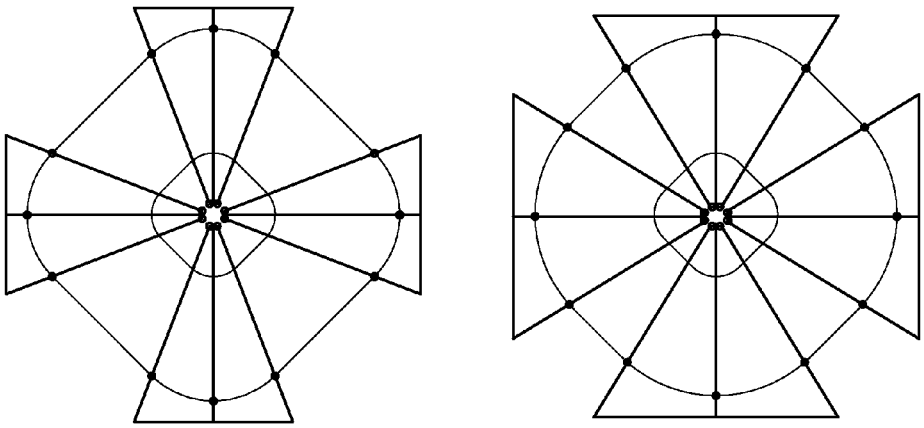
FIG. 6 shows two low energy FFAGs constructed from only F magnets.

As shown in FIG. 6, another unit-cell configuration utilizes only wedge-shaped F magnets. The vertical beam envelope is confined through edge focusing effects as is done in cyclotron beam dynamics. This latter single-magnet ring is very similar to a cyclotron with a strong gradient and has not been proposed or implemented in any other work for a nonscaling FFAG. Similarly, a long straight could be inserted at the centerline of the F magnets effectively splitting each single magnet into two components. In this embodiment, a strong gradient causes strong edge focusing in the vertical via the edge angle, thus much stronger than the "flutter" or vertical tune of cyclotrons which have more constant radial fields and dips or "valleys" in the azimuthal field rather than open spaces between magnets. Further, with stronger tunes, long spaces can be inserted at the midpoint of each F magnet to enhance injection, extraction or insertion of devices into the ring for various applications (such as targets for radioisotope production). This new type of FFAG is the most compact having no reverse bending fields.

4-8-MeV Machine Designs

In the nonrelativistic energy regime, a 4-cell 50 KeV to 8 MeV (kinetic energy) compact accelerator design was developed within a 6 cm to a 80-140 cm average radius, injection to extraction, using the approach described and Mathematica® for the optimization search and achieving an isochronous condition of <0.5%.

In the nonrelativistic regime, the velocity is proportional to momentum and momentum tracks the integrated magnetic field. This linear proportionality translates into a predominately linear increase in magnetic field or path length (a strong edge angle) with radius to maintain isochronous orbits. This linear gradient or quadrupole field is superimposed on a constant dipole field for the guide magnets. A linear gradient without strong higher order multipole components was also sufficient to contain the tune variation and permit beam stability (some curvature of the magnetic field gradient was needed for optimizing isochronous trajectories starting about 6 MeV). General parameters of the 8-MeV machine are set forth in Table 1a and Table 1b for a 1 T magnetic field (electromagnet version) and a lower, 4 kG magnetic field (permanent magnet version) as shown in FIG. 6, left to right, respectively. There are no reverse magnetic fields in this compact design, and vertical cell tunes are completely determined by the edge crossing term in the tune equation.

TABLE 1a

General Parameters of a 50 keV to 8 MeV nonscaling FFAG, 1T version

| Parameter | Unit | Injection | Extraction |
|---|---|---|---|
| Energy Range | MeV | 0.050 | 8.0 |
| Tune/cell ($\nu_x/\nu_y$) | 2π-rad | 0.265/0.295 | 0.265/0.295 |
| Machine Tune ($\nu_x/\nu_y$) | 2π-rad | 1.060/1.180 | 1.060/1.180 |
| Average Radius | m | 0.063 | 0.800 |
| No. cells | | 4 | |
| Magnet spacing | m | 0.050 | 0.634 |
| Field | kG | 10.34 | 10.52 |
| Magnet Lengths | m | 0.049 | 0.622 |
| Aperture | m | 0.737 | |

TABLE 1b

General Parameters of a 50 keV to 8 MeV nonscaling FFAG, 4 kG version

| Parameter | Unit | Injection | Extraction |
|---|---|---|---|
| Energy Range | MeV | 0.050 | 8.0 |
| Tune/cell ($\nu_x/\nu_y$) | 2π-rad | 0.251/0.186 | 0.251/0.186 |
| Machine Tune ($\nu_x/\nu_y$) | 2π-rad | 1.004/0.744 | 1.060/0.744 |
| Average Radius | m | 0.110 | 1.404 |
| No. cells | | 4 | |
| Magnet spacing | m | 0.051 | 0.647 |
| Field | kG | 4.16 | 4.20 |
| Magnet Lengths | m | 0.122 | 1.003 |
| Aperture | m | 1.294 | |

330-MeV Machine Designs:

In the nonrelativistic-relativistic energy range, two 30-330 MeV nonlinear non-scaling FFAG lattices have been developed and are described below:

A 4-cell non-scaling FFAG based on a DFD triplet layout, isochronous to ±0.7% (FIG. 5 and Table 2).

A 5-cell non-scaling FFAG also based on a DFD triplet layout, isochronous to ±1.26% (FIG. 5 and Table 3).

In the below designs, hard-edge tunes and fringe fields will decrease the vertical tune and raise the horizontal tune.

TABLE 2

General parameters for an initial 4-cell, 30-330 MeV FFAG.

| Parameter | Unit | Injection | Intermediate | Extraction |
|---|---|---|---|---|
| Energy Range | MeV | 30 | 151 | 330 |
| Tune/cell ($\nu_x/\nu_y$) | 2π-rad | 0.264/0.366 | 0.358/0.405 | —/0.441 |
| Machine Tune ($\nu_x/\nu_y$) | 2π-rad | 1.056/1.464 | 1.432/1.620 | —/1.764 |
| Average Radius | m | 1.923 | 4.064 | 5.405 |
| No. cells | | | 4 | |
| Magnet spacing | m | 0.435 | 0.539 | 0.613 |
| Long straight | m | | 2 | |
| Field F/D | T | 0.97/0.00 | 1.27/−0.70 | 1.51/−0.16 |
| Magnet Lengths | m | 1.28/0.10 | 2.4/0.45 | 3.18/1.04 |
| Aperture | m | | 3.482 | |

TABLE 3

General parameters 5-cell, 30 to 330-MeV FFAG.

| Parameter | Unit | Injection | Intermediate | Extraction |
|---|---|---|---|---|
| Energy Range | MeV | 30 | 151 | 330 |
| Tune/cell ($\nu_x/\nu_y$) | 2π-rad | 0.281/0.392 | 0.300/0.342 | 0.343/0.356 |
| Machine Tune ($\nu_x/\nu_y$) | 2π-rad | 1.124/1.568 | 1.200/1.368 | 1.372/1.424 |
| Average Radius | m | 2.983 | 5.063 | 6.428 |
| No. cells | | | 5 | |
| Magnet spacing | m | 0.493 | 0.523 | 0.549 |
| Long straight | m | | 2 | |

TABLE 3-continued

General parameters 5-cell, 30 to 330-MeV FFAG.

| Parameter | Unit | Injection | Intermediate | Extraction |
|---|---|---|---|---|
| Field F/D | kG | 1.07/−0.0 | 1.27/−0.7 | 1.53/−0.16 |
| Magnet Lengths | m | 0.94/.10 | 1.91/0.705 | 2.58/1.20 |
| Aperture | m | | 3.445 (ext-inj) | |

1-GeV Machine Designs:

Several 1 GeV nonlinear isochronous nonscaling FFAG lattices and magnetic field profiles have been developed:

A 0.25-1 GeV 4-cell nonscaling FFAG lattice based on a FDF triplet magnet layout, with an isochronous performance of ±3%.

A 0.33-1 GeV 6-cell nonscaling FFAG based on a DFD triplet layout, with an isochronous performance of ±0.9%.

A 0.33-1 GeV 7-cell nonscaling FFAG based on a DFD triplet layout, with an isochronous performance of ±1.2%.

In the below designs, hard-edge tunes and fringe fields will decrease the vertical tune and raise the horizontal tune.

TABLE 4

General parameters 4-cell, 0.25 to 1-GeV FFAG.

| Parameter | Unit | Injection | Intermediate | Extraction |
|---|---|---|---|---|
| Energy Range | MeV | 250 | 585 | 1000 |
| Tune/cell ($\nu_x/\nu_y$) | 2π-rad | 0.380/0.237 | 0.400/0.149 | 0.383/0.242 |
| Machine Tune ($\nu_x/\nu_y$) | 2π-rad | 1.520/0.948 | 1.600/0.596 | 1.532/0.968 |
| Average Radius | m | 3.419 | 4.307 | 5.030 |
| No. cells | | | 4 | |
| Magnet spacing | m | 0.289 | 0.405 | 0.505 |
| Long straight | m | | 2 | |
| Field F/D | kG | 1.62/−0.14 | 2.06/−0.31 | 2.35/−0.42 |
| Magnet Lengths | m | 1.17/0.38 | 1.59/0.79 | 1.94/1.14 |
| Aperture | m | | 1.611 | |

TABLE 5

General parameters 6-cell, 0.33 to 1-GeV FFAG.

| Parameter | Unit | Injection | Intermediate | Extraction |
|---|---|---|---|---|
| Energy Range | MeV | 330 | 500 | 1000 |
| Tune/cell ($\nu_x/\nu_y$) | 2π-rad | 0.297/0.196 | 0.313/0.206 | 0.367/0.235 |
| Machine Tune ($\nu_x/\nu_y$) | 2π-rad | 1.782/1.176 | 1.878/1.236 | 2.202/1.410 |
| Average Radius | m | 5.498 | 6.087 | 7.086 |
| No. cells | | | 6 | |
| Magnet spacing | m | 0.696 | 0.618 | 0.500 |
| Long straight | m | | 2 | |
| Field F/D | kG | 1.5/−0.0 | 1.6/−1.4 | 1.8/−3.8 |
| Magnet Lengths | m | 1.96/0.20 | 2.80/0.20 | 4.09/0.20 |
| Aperture | m | | 1.588 | |

TABLE 6

General parameters 7-cell, 0.33 to 1-GeV FFAG.

| Parameter | Unit | Injection | Intermediate | Extraction |
|---|---|---|---|---|
| Energy Range | MeV | 330 | 500 | 1000 |
| Tune/cell ($\nu_x/\nu_y$) | 2π-rad | 0.250/0.250 | 0.243/0.242 | 0.252/0.251 |
| Machine Tune ($\nu_x/\nu_y$) | 2π-rad | 1.750/1.750 | 1.701/1.694 | 1.764/1.757 |
| Average Radius | m | 4.354 | 4.816 | 5.651 |
| No. cells | | | 7 | |
| Magnet spacing | m | 0.300 | 0.374 | 0.502 |
| Long straight | m | | 2 | |

TABLE 6-continued

General parameters 7-cell, 0.33 to 1-GeV FFAG.

| Parameter | Unit | Injection | Intermediate | Extraction |
|---|---|---|---|---|
| Field F/D | kG | 3.3/−0.07 | 3.3/−0.7 | 3.8/−3.0 |
| Magnet Lengths | m | 0.79/0.25 | 1.10/0.25 | 1.67/0.25 |
| Aperture | m | | 0.772 | |

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

What is claimed is:

1. An accelerator system comprising:

a plurality of cells, each cell including a focus magnet and a defocus magnet each configured to create a magnetic field so as to confine and accelerate a particle beam, the focus magnet being configured to focus the particle beam in a horizontal direction and defocus the particle beam in a vertical direction, and the defocus magnet being configured to focus the particle beam in a vertical direction and defocus the particle beam in a horizontal direction, wherein each of the plurality of cells is configured to confine the particle beam in an isochronous orbit during acceleration, and wherein the accelerator system is a non-scaling fixed field alternating gradient (FFAG) particle accelerator.

2. The accelerator system as recited in claim 1, wherein the focus magnet is specified by the following focus parameters:

$B_{if}$, $B_{ef}$, $L_{if}$, $L_{ef}$, $\eta_f$, $\delta x_{if}$ wherein the defocus magnet is specified by the following defocus parameters:

$B_{id}$, $B_{ed}$, $L_{id}$, $L_{ed}$, $\eta_d$, $\delta x_{id}$ wherein the accelerator system is completely specified by the focus parameters, the defocus parameters, and the following additional parameters:

De, a drill between components at extraction, and

Nsectors, a number of periodic cells;

wherein the injection drift (Di) and the injection and extraction radii, $R_f$(avg), $R_e$(avg), can be expressed in terms of De, Nsectors, and magnet physical parameters; and wherein the focus parameters and the defocus parameters are related, in a thin lens approximation, by the following equations to confine the particles of the particle beam in a dynamically stable and isochronous orbit during acceleration:

$$k_{if} l_{if} + \frac{\theta_{if}}{\rho_{if}} + \frac{((\theta_{ef} - \theta_{if}) + \eta_{if})}{\rho_{if}} = 1/f_{if}$$

$$k_{id} L_{id} + \frac{\theta_{if} + \eta_{id}}{\rho_{id}} = 1/f_{id}$$

$$k_{ef} L_{ef} + \frac{\theta_{ef}}{\rho_{ef}} + \frac{\eta_{ef}}{\rho_{ef}} = 1/f_{ef}$$

$$k_{ed} L_{ed} + \frac{\theta_{ef} + \eta_{ed}}{\rho_{ed}} = 1/f_{ed}$$

$$\theta_{if} + \theta_{id} = \theta_{ef} + \theta_{ed} = \theta_{halfcell}$$

-continued $$L_{if}[\cos(\theta_{if})+\sin(\theta_{if})\tan(\theta_{ef}+\eta_{ef})] = L_{ef}\cos(\theta_{ef})-[\delta x_{if}-L_{ef}\sin(\theta_{ef})]\tan(\theta_{ef}+\eta_{ef})$$

$$L_{ed}\cos(\theta_{ef}) = L_{id}\cos(\theta_{if})+\delta x_{id}\sin(\theta_{id}+\theta_{if})+[\delta x_{if}+(L_{if}+D_i)\sin(\theta_{if})-(L_{ef}+D_e)\sin(\theta_{ef})]\tan(\eta_{ed})$$

$$D_i[\cos(\theta_{if})-\sin(\theta_{if})\tan(\eta_{ed})] = (L_{ef}+D_e)\cos(\theta_{ef})-L_{if}\cos(\theta_{if})+[\delta x_{if}+L_{if}\sin(\theta_{if})-(L_{ef}+D_e)\sin(\theta_{ef})]\tan(\eta_{ed})$$

$$\delta x_{id}\cos(\theta_{id}+\theta_{if}) = \delta x_{if}+L_{ihalf}\sin(\theta_{if})-L_{ehalf}\sin(\theta_{ef})$$

$$R_e(avg) = \frac{\beta_e}{\beta_i}R_i(avg)$$

$$R_i(avg) = \frac{2L_i(halfcell)}{2\pi} = \frac{Nsector(L_{if}+L_{id}+D_i+D_l)}{\pi}$$

$$R_e(avg) = \frac{2L_e(halfcell)}{2\pi} = \frac{Nsector(L_{ef}+L_{ed}+D_e+D_l)}{\pi}.$$

3. The accelerator system as recited in claim 1, wherein the accelerator system includes a proton accelerator.

4. The accelerator system as recited in claim 3, wherein the plurality of cells includes 4 cells, a magnet aperture is about 3.482 m, a long straight is about 2 m, and an isochronous behavior is about ±0.7%, wherein at an injection of the particle beam, the particle beam includes a beam energy of about 30 MeV,
a radius of the particle beam is about 1.923 m,
an F/D separation includes a magnet spacing of about 0.435 m,
the magnetic field of the F magnet is about 0.97 T,
the magnetic field of the D magnet is about 0 T,
a magnet length of the F magnet is about 1.28 m, and
a magnet length of the D magnet is about 0.10 m, and wherein at an extraction of the particle beam, the particle beam includes a beam energy of up to 330 MeV,
a radius of the particle beam is about 5.405 m,
an F/D separation includes a magnet spacing of about 0.613 m,
the magnetic field of the F magnet is about 1.51 T,
the magnetic field of the D magnet is about −0.16 T,
a magnet length of the F magnet is about 3.18 m, and
a magnet length of the D magnet is about 1.04 m.

5. The accelerator system as recited in claim 3, wherein the plurality of cells includes 5 cells, a magnet aperture is about 3.445 m, a long straight is about 2 m, and an isochronous behavior is about ±1.26%, wherein at an injection of the particle beam, the particle beam includes a beam energy of about 30 MeV,
a radius of the particle beam is about 2.983 m,
an F/D separation includes a magnet spacing of about 0.493 m,
the magnetic field of the F magnet is about 1.07 kG,
the magnetic field of the D magnet is about 0 kG,
a magnet length of the F magnet is about 0.94 m, and
a magnet length of the D magnet is about 0.1 m, and wherein at an extraction of the particle beam, the particle beam includes a beam energy of up to 330 MeV,
a radius of the particle beam is about 6.428 m,
an F/D separation includes a magnet spacing of about 0.549 m,
the magnetic field of the F magnet is about 1.53 kG,
the magnetic field of the D magnet is about −0.16 kG,
a magnet length of the F magnet is about 2.58 m, and
a magnet length of the D magnet is about 1.20 m.

6. The accelerator system as recited in claim 3, wherein the plurality of cells includes 4 cells, a magnet aperture is about 1.611 m, a long straight is about 2 m, and an isochronous behavior is about ±3%, wherein at an injection of the particle beam, the particle beam includes a beam energy of about 250 MeV,
a radius of the particle beam is about 3.419 m,
an F/D separation includes a magnet spacing of about 0.289 m,
the magnetic field of the F magnet is about 1.62 kG,
the magnetic field of the D magnet is about −0.14 kG,
a magnet length of the F magnet is about 1.17 m, and
a magnet length of the D magnet is about 0.38, and wherein at an extraction of the particle beam, the particle beam includes a beam energy of up to 1000 MeV,
a radius of the particle beam is about 5.030 m,
an F/D separation includes a magnet spacing of about 0.505 m,
the magnetic field of the F magnet is about 2.35 kG,
the magnetic field of the D magnet is about −0.42 kG,
a magnet length of the F magnet is about 1.94 m, and
a magnet length of the D magnet is about 1.14 m.

7. The accelerator system as recited in claim 3, wherein the plurality of cells includes 6 cells, a magnet aperture is about 1.588 m, a long straight is about 2 m, and an isochronous behavior is about ±0.9%, wherein at an injection of the particle beam, the particle beam includes a beam energy of about 330 MeV,
a radius of the particle beam is about 5.498 m,
an F/D separation includes a magnet spacing of about 0.696 m,
the magnetic field of the F magnet is about 1.5 kG,
the magnetic field of the D magnet is about −0.0 kG,
a magnet length of the F magnet is about 1.96 m, and
a magnet length of the D magnet is about 0.20 m, and wherein at an extraction of the particle beam, the particle beam includes a beam energy of up to 1000 MeV,
a radius of the particle beam is about 7.086 m,
an F/D separation includes a magnet spacing of about 0.500 m,
the magnetic field of the F magnet is about 1.8 kG,
the magnetic field of the D magnet is about −3.8 kG,
a magnet length of the F magnet is about 4.09 m, and
a magnet length of the D magnet is about 0.20 m.

8. The accelerator system as recited in claim 3, wherein the plurality of cells includes 7 cells, a magnet aperture is about 0.772 m, a long straight is about 2 m, and an isochronous behavior is about ±1.2%, wherein at an injection of the particle beam, the particle beam includes a beam energy of about 330 MeV,
a radius of the particle beam is about 4.354 m,
an F/D separation includes a magnet spacing of about 0.300 m,
the magnetic field of the F magnet is about 3.3 kG,
the magnetic field of the D magnet is about −0.07 kG,
a magnet length of the F magnet is about 0.79 m, and
a magnet length of the D magnet is about 0.25, and wherein at an extraction of the particle beam, the particle beam includes a beam energy of up to 1000 MeV,
a radius of the particle beam is about 5.651 m, an F/D separation includes a magnet spacing of about 0.502 m, the magnetic field of the F magnet is about 3.8 kG, the magnetic field of the D magnet is about −3.0 kG, a magnet length of the F magnet is about 1.67 m, and a magnet length of the D magnet is about 0.25 m.

9. An accelerator system comprising:

a plurality of cells, each cell including a wedge-shaped focus magnet configured to create a magnetic field so as to confine and accelerate a particle beam and configured to focus the particle beam in both a horizontal direction and in a vertical direction, wherein each of the plurality of cells is configured to confine the particle beam in an isochronous orbit during acceleration, and wherein the accelerator system is a non-scaling fixed field alternating gradient particle accelerator.

10. The accelerator system as recited in claim 9, wherein the focus magnet is specified by the following focus parameters:

$B_{if}$, $B_{ef}$, $L_{if}$, $L_{ef}$, $\eta_f$, $\delta x_{if}$ wherein the accelerator system is specified by the following parameters:

$\rho_{if}$, $\rho_{ef}$, f, $R_i$(avg), $R_e$(avg)

wherein the focus parameters are related by the following equations such that particle beam is confined to the isochronous orbit during acceleration:

$$k_{if} l_{if} + \frac{\theta_{if}}{\rho_{if}} + \frac{((\theta_{ef} - \theta_{if}) + \eta_{if})}{\rho_{if}} = 1/f_{if}$$

$$-\frac{\eta_{if}}{\rho_{if}} = 1/f_{id}$$

$$k_{ef} L_{ef} + \frac{\theta_{ef}}{\rho_{ef}} + \frac{\eta_{ef}}{\rho_{ef}} = 1/f_{ef}$$

$$-\frac{\eta_{ef}}{\rho_{ef}} = 1/f_{ed}$$

$$\theta_{if} = \theta_{ef} = \theta_{halfcell}$$

$$L_{if}[\cos(\theta_{if}) + \sin(\theta_{if})\tan(\theta_{ef} + \eta_{ef})] = L_{ef}\cos(\theta_{ef}) - [\delta x_{if} - L_{ef}\sin(\theta_{ef})]\tan(\theta_{ef} + \eta_{ef})$$

$$D_i[\cos(\theta_{if}) - \sin(\theta_{if})\tan(\theta_{ef} + \eta_{ef})] = (L_{ef} + D_e)\cos(\theta_{ef}) - L_{if}\cos(\theta_{if}) + [\delta x_{if} + L_{if}\sin(\theta_{if}) - (L_{ef} + D_e)\sin(\theta_{ef})]\tan(\theta_{ef} + \eta_{ef})$$

$$R_e(avg) = \frac{\beta_e}{\beta_i} R_i(avg)$$

$$R_i(avg) = \frac{2L_i(halfcell)}{2\pi} = \frac{Nsector(L_{if} + D_i + D_l)}{\pi}$$

$$R_e(avg) = \frac{2L_e(halfcell)}{2\pi} = \frac{Nsector(L_{ef} + D_e + D_l)}{\pi}.$$

11. The accelerator system as recited in claim 9, wherein the magnetic field is configured to increase with particle beam radius so as to maintain the isochronous orbit of the particle beam.

12. The accelerator system as recited in claim 9, wherein the accelerator system includes a proton accelerator.

13. The accelerator system as recited in claim 9, wherein the focus magnet is split into two components at a centerline of the focus magnet.

14. The accelerator system as recited in claim 9, wherein the plurality of cells includes 4 cells, wherein a magnet aperture is about 0.737 m, wherein at an injection of the particle beam, the particle beam includes a beam energy of about 0.50 MeV, a radius of the particle beam is about 0.063 m, an F separation includes a magnet spacing of about 0.05 m, the magnetic field is about 10.34 kG, a magnet length of the F magnet is about 0.049 m, and wherein at an extraction of the particle beam, the particle beam includes a beam energy of up to 8 MeV, a radius of the particle beam is about 0.800 m, an F separation includes a magnet spacing of about 0.634 m, the magnetic field is about 10.52 kG, and a magnet length of the F magnet is about 0.622 m.

15. The accelerator system as recited in claim 9, wherein the plurality of cells includes 4 cells, a magnet aperture is about 1.294 m based on a maximum magnetic field, and an isochronous behavior is about ±0.5%, wherein at an injection of the particle beam, the particle beam includes a beam energy of about 50 keV, a radius of the particle beam is about 0.110 m, an F separation includes a magnet spacing of about 0.051 m, the magnetic field is about 4.16 kG, a magnet length of the F magnet is about 0.122 m, and wherein at an extraction of the particle beam, the particle beam includes a beam energy of up to 8 MeV, a radius of the particle beam is about 1.404 m, an F separation includes a magnet spacing of about 0.647 m, the magnetic field is about 4.20 kG, a magnet length of the F magnet is about 1.003 m.

16. A method for controlling and accelerating a continuous particle beam in a non-scaling fixed field alternating gradient particle accelerator comprising:

providing a plurality of cells, each cell including a focus magnet and a defocus magnet each configured to create a magnetic field so as to confine and accelerate the particle beam, the focus magnet being configured to focus the particle beam in a horizontal direction and defocus the particle beam in a vertical direction, and the defocus magnet being configured to focus the particle beam in a vertical direction and defocus the particle beam in a horizontal direction;

specifying magnet parameters and accelerator system parameters such that a stable machine tune is obtained for each cell; and constraining a path length of the accelerator system according to an isochronous condition.

17. The method as recited in claim 16, wherein the specifying includes assigning the following parameters to the focus magnet:

$B_{if}$, $B_{ef}$, $L_{if}$, $L_{ef}$, $\eta_f$, $\delta x_{if}$ assigning the following parameters to the defocus magnet:

$B_{id}$, $B_{ed}$, $L_{id}$, $L_{ed}$, $\eta_d$, $\delta x_{id}$ assigning the following parameters to the accelerator system:

$\rho_{if}$, $\rho_{ef}$, $\rho_{id}$, $\rho_{ed}$, f, $R_i$(avg), $R_e$(avg)

relating the parameters using the following equations so as to derive the magnet requirements:

$$k_{if} l_{if} + \frac{\theta_{if}}{\rho_{if}} + \frac{((\theta_{ef} - \theta_{if}) + \eta_{if})}{\rho_{if}} = 1/f_{if}$$

$$k_{id} L_{id} + \frac{\theta_{if} + \eta_{id}}{\rho_{id}} = 1/f_{id}$$

-continued $$k_{ef}L_{ef} + \frac{\theta_{ef}}{\rho_{ef}} + \frac{\eta_{ef}}{\rho_{ef}} = 1/f_{ef}$$

$$k_{ed}L_{ed} + \frac{\theta_{ef} + \eta_{ed}}{\rho_{ed}} = 1/f_{ed}$$

$$\theta_{if} + \theta_{id} = \theta_{ef} + \theta_{ed} = \theta_{halfcell}$$

$$L_{if}[\cos(\theta_{if}) + \sin(\theta_{if})\tan(\theta_{ef} + \eta_{ef})] = L_{ef}\cos(\theta_{ef}) - [\delta x_{if} - L_{ef}\sin(\theta_{ef})]\tan(\theta_{ef} + \eta_{ef})$$

$$L_{ed}\cos(\theta_{ef}) = L_{id}\cos(\theta_{if}) + \delta x_{id}\sin(\theta_{id} + \theta_{if}) + [\delta x_{if} + (L_{if} + D_i)\sin(\theta_{if}) - (L_{ef} + D_e)\sin(\theta_{ef})]\tan(\eta_{ed})$$

$$D_i[\cos(\theta_{if}) - \sin(\theta_{if})\tan(\eta_{ed})] = (L_{ef} + D_e)\cos(\theta_{ef}) - L_{if}\cos(\theta_{if}) + [\delta x_{if} + L_{if}\sin(\theta_{if}) - (L_{ef} + D_e)\sin(\theta_{ef})]\tan(\eta_{ed})$$

$$\delta x_{id}\cos(\theta_{id} + \theta_{if}) = \delta x_{if} + L_{ihalf}\sin(\theta_{if}) - L_{ehalf}\sin(\theta_{ef})$$

and wherein the isochronous condition is:

$$R_e(avg) = \frac{\beta_e}{\beta_i}R_i(avg), \text{ with}$$

$$R_i(avg) = \frac{2L_i(halfcell)}{2\pi} = \frac{Nsector(L_{if} + L_{id} + D_i + D_l)}{\pi} \text{ and}$$

$$R_e(avg) = \frac{2L_e(halfcell)}{2\pi} = \frac{Nsector(L_{ef} + L_{ed} + D_e + D_l)}{\pi}.$$

18. The method as recited in claim 16, wherein the particle beam is a proton beam.

19. The accelerator system as recited in claim 1, further comprising a fixed-frequency radio frequency (RF) acceleration system.

20. The accelerator system as recited in claim 1, wherein the particle beam is continuously injected and accelerated.

* * * * *